US010175615B1

(12) United States Patent
Kouzu

(10) Patent No.: US 10,175,615 B1
(45) Date of Patent: Jan. 8, 2019

(54) TRANSFER BELT UNIT AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Norio Kouzu, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/698,736

(22) Filed: Sep. 8, 2017

(51) Int. Cl.
*G03G 15/01* (2006.01)
*G03G 15/16* (2006.01)

(52) U.S. Cl.
CPC ..... *G03G 15/1685* (2013.01); *G03G 15/0136* (2013.01)

(58) Field of Classification Search
CPC ..... G03G 15/0136; G03G 15/0178; G03G 15/1685; G03G 2215/0119; G03G 2215/0193
USPC ..... 399/299
See application file for complete search history.

(56) References Cited

U.S. PATENT DOCUMENTS

| | | | | |
|---|---|---|---|---|
| 5,765,082 | A * | 6/1998 | Numazu | G03G 15/01 399/299 |
| 8,417,164 | B2 | 4/2013 | Ichihashi et al. | |
| 8,811,867 | B2 | 8/2014 | Ichihashi et al. | |
| 2002/0018673 | A1* | 2/2002 | Mizoguchi | G03G 15/0131 399/298 |
| 2005/0158074 | A1* | 7/2005 | Murakami | G03G 15/01 399/121 |
| 2011/0249992 | A1* | 10/2011 | Yoshida | G03G 15/0136 399/299 |
| 2014/0169840 | A1* | 6/2014 | Yokoyama | G03G 15/0136 399/298 |
| 2015/0147100 | A1* | 5/2015 | Okamoto | G03G 15/0136 399/302 |
| 2016/0349672 | A1* | 12/2016 | Miyakoshi | G03G 15/0136 |

FOREIGN PATENT DOCUMENTS

JP 2004-109455 4/2004

* cited by examiner

*Primary Examiner* — Sophia S Chen
(74) *Attorney, Agent, or Firm* — Amin, Turocy & Watson LLP

(57) ABSTRACT

In accordance with an embodiment, a transfer belt unit includes a transfer belt, a transfer roller, a switching member and a holding member. The transfer belt is wound into an endless shape. The transfer roller is arranged at the inside of the transfer belt to face a photoconductor. The switching member can switch the transfer belt between a transfer position where the transfer belt abuts against the photoconductor and a separation position where the transfer belt is away from the photoconductor. The holding member separates the transfer belt from the photoconductor in conjunction with the switching member.

18 Claims, 8 Drawing Sheets

TRANSFER BELT UNIT AND IMAGE FORMING APPARATUS

FIELD

Embodiments described herein relate generally to a transfer belt unit and an image forming apparatus.

BACKGROUND

Conventionally, an image forming apparatus (e.g., an MFP) includes a transfer belt and a photoconductive drum. The transfer belt and the photoconductive drum are consumables, and therefore need to be periodically replaced. Particularly, the photoconductive drum includes a color photoconductive drum and a monochrome photoconductive drum, which has higher exchange frequency than the transfer belt. At the time of replacing the photoconductive drum, in order to prevent the transfer belt from being damaged, it is necessary to separate the transfer belt from the photoconductive drum. Since the transfer belt is in a non-contact state with respect to the photoconductive drum, a position of the transfer belt arranged at the inside of the transfer belt is moved by a position switching roller.

However, in a case in which the transfer belt deteriorates and is stretched over time, there is not enough tension to be applied to the transfer belt. Therefore, the transfer belt cannot be separated from the photoconductive drum. At the time of replacing the photoconductive drum, there is a problem that components of the photoconductive drum undesirably rub and hook the transfer belt, and the transfer belt becomes damaged.

DETAILED DESCRIPTION

In accordance with an embodiment, a transfer belt unit comprises a transfer belt, a transfer roller, a switching member and a holding member. The transfer belt is wound into an endless shape. The transfer roller is arranged at the inside of the transfer belt to face a photoconductor. The switching member can switch the transfer belt between a transfer position where the transfer belt abuts against the photoconductor and a separation position where the transfer belt is away from the photoconductor. The holding member separates the transfer belt from the photoconductor in conjunction with the switching member.

Hereinafter, an image forming apparatus of an embodiment is described with reference to the accompanying drawings.

Figure 1:
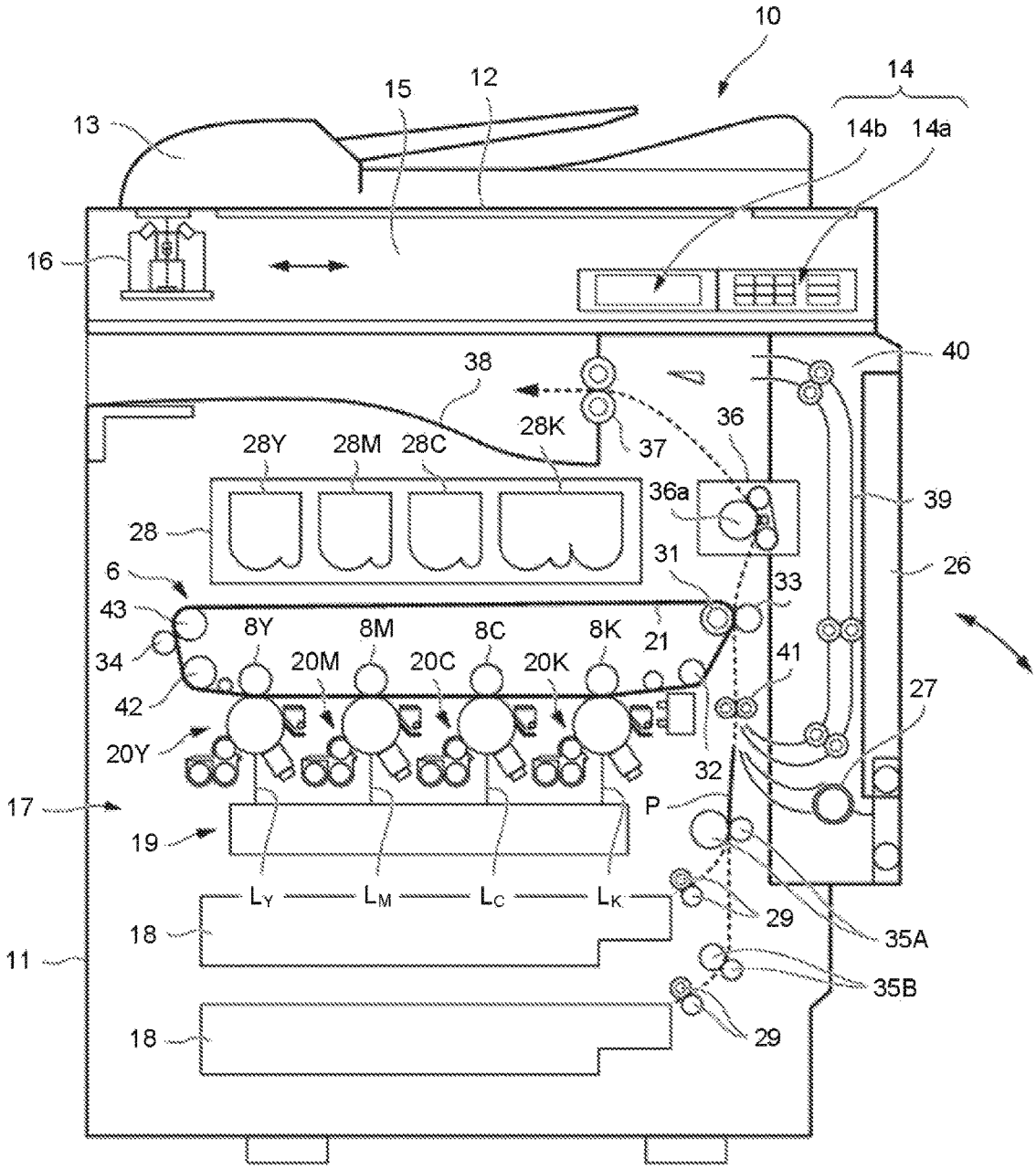
FIG. 1 is a schematic constitution diagram illustrating an image forming apparatus according to an embodiment.

With reference to FIG. 1 to FIG. 9, a transfer belt unit 6 in an image forming apparatus 10 according to an embodiment is described. FIG. 1 is a schematic constitution diagram illustrating an image forming apparatus 10. FIG. 1 is a sectional schematic view exemplifying the constitution of the image forming apparatus 10 according to the embodiment. In FIG. 1, for the sake of visibility, a size and shape of each member are exaggerated or simplified (other figures are the same).

As shown in FIG. 1, the image forming apparatus 10 of the embodiment is, for example, an MFP (Multi-Function Peripheral), a printer, a copying machine, and the like. An example in which the image forming apparatus 10 is an MFP is described below.

A document table 12 including a transparent glass is provided at the top of an apparatus main body 11 of the image forming apparatus 10. An automatic document feeder (ADF) 13 is provided on the document table 12. At the top of the apparatus main body 11, an operation section 14 is provided. The operation section 14 includes an operation panel 14*a* having various keys and a touch panel type display section 14*b*.

A scanner section 15 which is a reading apparatus is provided below the ADF 13. The scanner section 15 reads an original document sent by the ADF 13 or an original document placed on the document table 12. The scanner section 15 generates image data of the original document. For example, the scanner section 15 includes an image sensor 16. For example, the image sensor 16 may be a contact type image sensor.

The image sensor 16 moves along the document table 12 at the time of reading the image of the original document placed on the document table 12. The image sensor 16 reads an original document by each line for one page of the document image. If the image of the original document sent by the ADF 13 is read, the image sensor 16 reads the sent original document at a fixed position shown in FIG. 1.

The apparatus main body 11 of the image forming apparatus 10 has a printer section 17 at a center in a height direction. The apparatus main body 11 has a sheet feed cassette 18 (sheet housing section) and a manual feed tray 26 at the bottom thereof. The sheet feed cassette 18 is arranged inside the apparatus main body 11. The number of the sheet feed cassettes 18 may be an arbitrary number of 1 or more.

In the example shown in FIG. 1, two pairs of the sheet feed cassettes 18 are arranged in a vertical direction.

The manual feed tray 26 can be opened and closed. The manual feed tray 26 is arranged in an automatic double-side device 40 described later provided at one side of the apparatus main body 11. The automatic double-side device 40 can also be opened and closed. The manual feed tray 26 is suitable for supplying a large sheet, a special sheet, a small number of nonstandard sheets and the like which do not enter the sheet feed cassette 18. If not in use, the manual feed tray 26 is stored in the automatic double-side device 40 and is opened to a horizontal position at the time of use. The manual feed tray 26 in use may be not horizontal but inclined upward or downward.

The sheet feed cassettes 18 accommodate sheets P of various sizes. The sheet feed cassettes 18 and the manual feed tray 26 accommodate the sheets P of various sizes based on a central reference.

The sizes of the sheets P accommodated in each of the sheet feed cassettes 18 and the manual feed tray 26 are detected by a paper size detection mechanism (not shown). Different types of sheets P may be stored in the sheet feed cassettes 18 and the manual feed tray 26. As an example of the type of the sheet P, there are categories depending on the thickness of the sheet P. For example, the types of the sheets P accommodated in the sheet feed cassettes 18 and the manual feed tray 26 may be input through the operation panel 14*a* or the display section 14*b*.

In the apparatus main body 11, in the vicinity of each sheet feed cassette 18, a conveyance mechanism 29 (conveyance section) is arranged. The conveyance mechanism 29 feeds the sheet P fed from the sheet feed cassette 18 to a main body conveyance path. The conveyance mechanism 29 has an appropriate constitution capable of preventing double feeding of the sheet P. For example, as the constitution of the conveyance mechanism 29, a constitution with a FRR sheet feed system may be used.

The manual feed tray 26 has a manual feed conveyance mechanism 27. The manual feed conveyance mechanism 27 picks up the sheets P one by one from the manual sheet feed tray 26 and sends it to the main body conveyance path.

The printer section 17 forms an image on the sheet P based on image data read by the scanner section 15 or image data created by a personal computer. The printer section 17 is a color printer of a tandem system.

The printer section 17 includes image forming sections 20Y, 20M, 20C and 20K of yellow (Y), magenta (M), cyan (C), and black (K) colors, an exposure device 19, and an transfer belt 21.

The image forming sections 20Y, 20M, 20C and 20K are arranged under the transfer belt 21. The image forming sections 20Y, 20M, 20C and 20K are arranged in parallel along a downstream side from an upstream side in a movement direction (a direction from the left side to the right side in FIG. 1) below the transfer belt 21.

The exposure device 19 emits exposure light LY, LM, LC and LK to the image forming sections 20Y, 20M, 20C and 20K, respectively. The exposure device 19 may generate a laser scanning beam as the exposure light. The exposure device 19 may include a solid-state scanning element such as an LED for generating the exposure light. The constitutions of the image forming sections 20Y, 20M, 20C and 20K are common to each other except that the color of a toner therein is different.

Each of the image forming sections 20Y, 20M, 20C and 20K has a known electrophotographic system constitution in common. For example, the image forming sections 20Y, 20M, 20C and 20K have photoconductive drums (photoconductors) 7Y, 7M, 7C and 7K, respectively. In the periphery of each of the photoconductive drums 7Y, 7M, 7C and 7K, a charging device, a developing device, primary transfer rollers 8Y, 8M, 8C or 8K, a cleaner, a blade, and the like are arranged along a rotation direction of each of the photoconductive drums 7Y, 7M, 7C and 7K.

The charging device uniformly charges the surfaces of the photoconductive drums 7Y, 7M, 7C and 7K. The exposure device 19 generates the exposure light modulated based on the image data of each color. The exposure light exposes the surfaces of the photoconductive drums 7Y, 7M, 7C and 7K. The exposure device forms electrostatic latent images on the photoconductive drums 7Y, 7M, 7C and 7K. The developing devices supply toner to the photoconductive drums 7Y, 7M, 7C and 7K by a developing roller to which a developing bias is applied. The developing devices develop the electrostatic latent images on the photoconductive drums 7Y, 7M, 7C and 7K. The cleaners have blades abutting against the photoconductive drums 7Y, 7M, 7C and 7K. The blades remove residual toner on the surfaces of the photoconductive drums 7Y, 7M, 7C and 7K.

As shown in FIG. 1, at the top of the transfer belt unit 6, a toner cartridge 28 is arranged.

The toner cartridge 28 supplies toner to the developing devices of the image forming sections 20Y, 20M, 20C and 20K, respectively. The toner cartridge 28 has toner cartridges 28Y, 28M, 28C and 28K. The toner cartridges 28Y, 28M, 28C and 28K store a yellow toner, a magenta toner, a cyan toner, and a black toner, respectively.

The transfer belt 21 is formed into an endless shape and moves cyclically. The transfer belt 21 is wrapped around a driving roller 31 and a plurality of driven rollers 32. The transfer belt 21 is in contact with the photoconductive drums 7Y, 7M, 7C and 7K of the image forming sections 20Y, 20M, 20C and 20K from above. At the transfer belt 21, at the positions facing the photoconductive drums 7Y, 7M, 7C and 7K, the primary transfer rollers 8Y, 8M, 8C and 8K of the image forming sections 20Y, 20M, 20C and 20K are provided at the inside of the transfer belt 21.

If a primary transfer voltage is applied, each of the primary transfer rollers 8Y, 8M, 8C and 8K primarily transfers the toner image on each of the photoconductive drums 7Y, 7M, 7C and 7K onto the transfer belt 21. The photoconductive drums 7Y, 7M, 7C and 7K constitute an image carrier which carries a toner image from a developing position to a primary transfer position.

A secondary transfer roller 33 is opposed to the driving roller 31 across the transfer belt 21. An abutment part between the transfer belt 21 and the secondary transfer roller 33 constitutes a secondary transfer position. The driving roller 31 rotationally drives the transfer belt 21. The transfer belt 21 rotationally driven constitutes an image carrier carrying a toner image from the primary transfer position to the secondary transfer position.

A secondary transfer voltage is applied to the secondary transfer roller 33 at the time the sheet P passes through the secondary transfer position. If the secondary transfer voltage is applied to the secondary transfer roller 33, the secondary transfer roller 33 secondarily transfers the toner image on the transfer belt 21 onto the sheet P.

As shown in FIG. 1, a belt cleaner 34 is arranged nearby a tension roller 43. The belt cleaner 34 removes the residual transfer toner on the transfer belt 21 from the transfer belt 21.

Conveyance rollers 35B and 35A and a resist roller 41 are provided on the main body conveyance path from each sheet feed cassette 18 to the secondary transfer roller 33. The conveyance roller 35B conveys the sheet P taken out of the lower sheet feed cassette 18 towards the conveyance roller 35A. The conveyance roller 35A conveys the sheet P taken out of the upper or lower sheet feed cassette 18 towards the resist roller 41.

The resist roller 41 aligns the positions of the tips of the sheets P conveyed by the conveyance roller 35A. The resist roller 41 conveys the sheet P and makes the tip of a transfer region of the toner image on the sheet P reach the secondary transfer position. The transfer region of the toner image is a region excluding a formation area with blank edge on the sheet P.

Between the manual feed conveyance mechanism 27 and the resist roller 41, a conveyance path is formed by a conveyance guide. The manual feed conveyance mechanism 27 conveys the sheet P taken out of the manual feed tray 26 toward the conveyance guide. The sheet P moving along the conveyance guide reaches the resist roller 41.

At the downstream side (upper side in FIG. 1) of the secondary transfer roller 33 in the conveyance direction of the sheet P, a fixing device 36 is arranged. A conveyance roller 37 is arranged at the downstream side (upper left side in FIG. 1) of the fixing device 36 in the conveyance direction of the sheet P. The conveyance roller 37 discharges the sheet P to a sheet discharge section 38.

The fixing device 36 fixes the toner image on the sheet P. The fixing device 36 fixes the toner image by heating and pressurizing the toner image on the sheet P. For example, a constitution of the fixing device 36 may be a well-known roller fixing type constitution. For example, a constitution of the fixing device 36 may be a well-known belt fixing system constitution. The fixing device 36 has at least a heat roller 36*a*, a heating source and a temperature detection sensor. The heat roller 36*a* heats the toner image. The heating source heats the heat roller 36*a*. The temperature detection sensor detects the temperature of the heat roller 36*a*.

An inversion conveyance path 39 is arranged at the downstream side (right side in FIG. 1) of the fixing device 36 in the conveyance direction of the sheet P. The inversion conveyance path 39 reverses the sheet P to guide it to the upstream side of the resist roller 41. The inversion conveyance path 39 is used for duplex printing. The inversion conveyance path 39 is arranged in the automatic double-side device 40. If the automatic double-side device 40 is opened to the outside of the apparatus main body 11, the inversion conveyance path 39 is also unlocked.

Next, referring to FIG. 2 to FIG. 9, the transfer belt unit 6 is described.

Figure 2A:
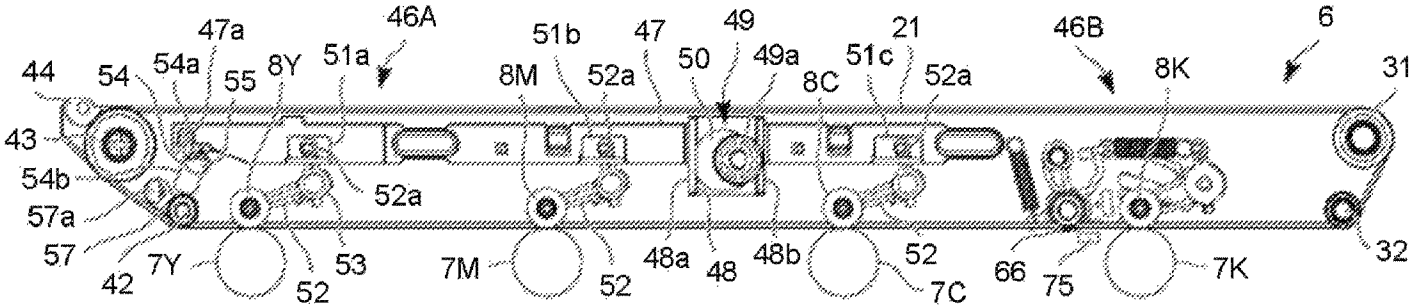
FIG. 2A is a constitution diagram illustrating a first operation of a transfer belt unit according to the embodiment.
Figure 2B:
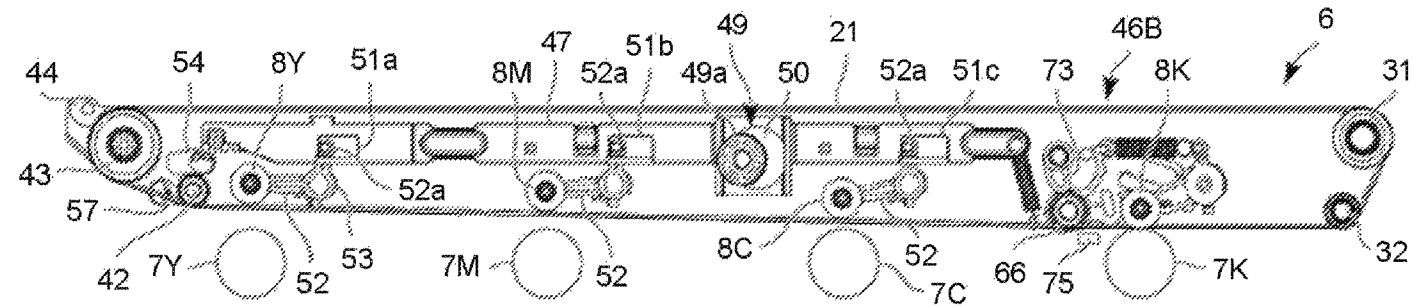
FIG. 2B is a constitution diagram illustrating a second operation of the transfer belt unit according to the embodiment.
Figure 2C:
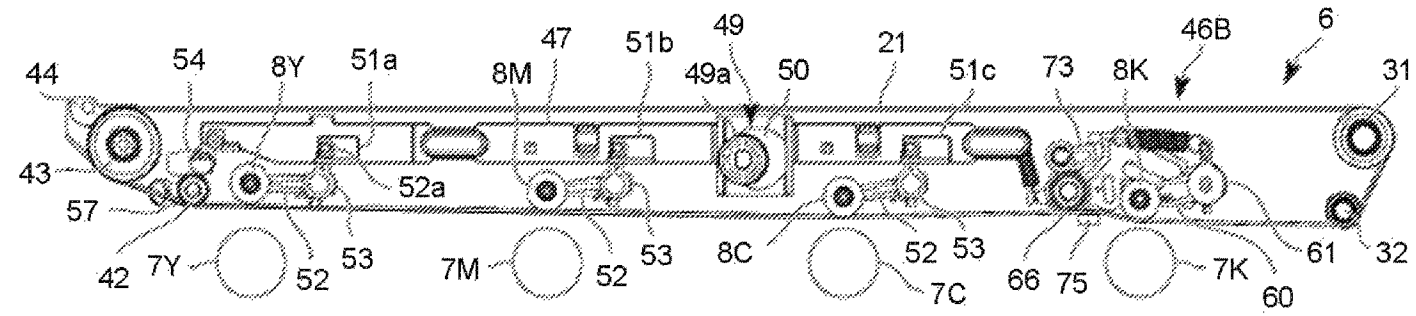
FIG. 2C is a constitution diagram illustrating a third operation of the transfer belt unit according to the embodiment.
Figure 3:
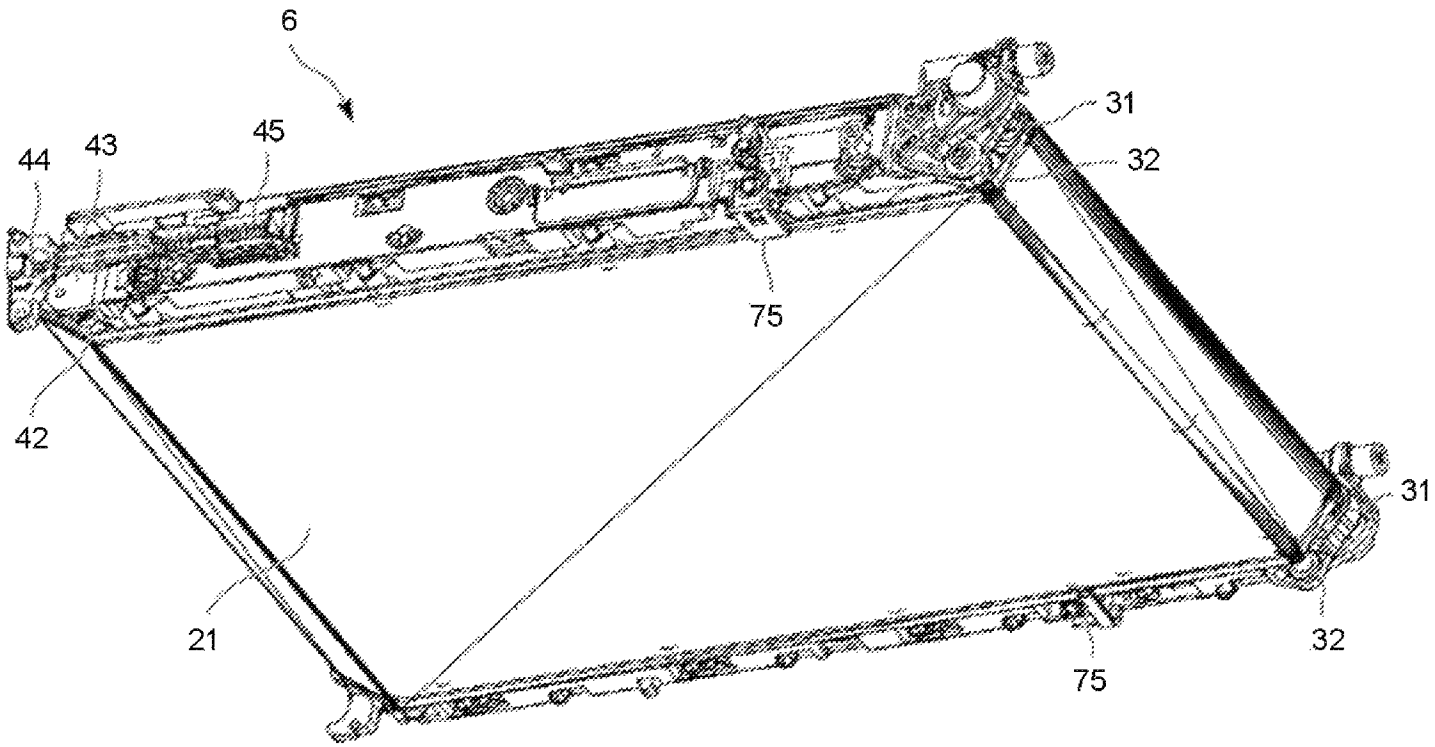
FIG. 3 is a perspective view illustrating the transfer belt unit according to the embodiment.

In FIG. 2A to FIG. 3, the transfer belt 21 of the transfer belt unit 6 has the driving roller 31 arranged at one end side at the upper side thereof and the tension roller 43 arranged at the other end side. The tension roller 43 is connected to a roller supporting section 44 provided at the outside thereof. The roller supporting section 44 is connected to a tension spring 45 in a compressed state provided at the side of the transfer belt unit 6. The roller supporting section 44 is pushed outward by an elastic force of the tension spring 45. The tension roller 43 supported by the roller supporting section 44 presses the transfer belt 21 outward. The elastic force of the tension spring 45 adjusts the tension of the transfer belt 21. The lower side of the transfer belt 21 is stretched by a first position switching roller 42 and the driven roller 32 respectively provided at the left and right ends.

A control mechanism of color photoconductor 46A for controlling the pressing and releasing of the transfer belt 21 to the color photoconductor and a control mechanism of monochrome photoconductor 46B are arranged at the inside of the transfer belt 21. The control mechanism of color photoconductor 46A is described.

A slider 47 is arranged along a longitudinal direction of the transfer belt 21 at both ends (or only one end) in the width direction of the transfer belt unit 6. A concave part 48 having pressing surfaces 48*a* and 48*b* formed at the left and right sides is provided at a center part in the longitudinal direction of the slider 47. In the concave part 48, an eccentric cam 49 rotatably supported by a base part 49*a* is arranged. For example, a cam part 50 of the eccentric cam 49 can rotate 180 degrees. If the cam part 50 of the eccentric cam 49 is positioned at the left side in FIG. 2A, the pressing surface 48*a* is pressed to move the slider 47 to the left side (refer to FIG. 2A). If the cam part 50 is positioned at the right side in FIG. 2B and FIG. 2C, the pressing surface 48*b* is pressed to move the slider 47 to the right side (refer to FIG. 2B and FIG. 2C).

Below the transfer belt 21, the photoconductive drums 7Y, 7M, 7C and 7K of the image forming sections 20Y, 20M, 20C and 20K are arranged at predetermined intervals. The photoconductive drums 7Y, 7M and 7C are the color photoconductors, and the photoconductive drum 7K is the monochrome photoconductor.

At the inside of the transfer belt 21, the primary transfer rollers 8Y, 8M and 8C capable of pressing the transfer belt 21 against the photoconductive drums 7Y, 7M and 7C which are the color photoconductors are arranged at predetermined intervals. The primary transfer rollers 8Y, 8M and 8C are fixed to one ends of substantially L-shaped arm sections 52, respectively. An interlocking part 52*a* is provided at the other ends of each arm section 52, and a shaft 53 is provided at a bending part. Each arm section 52 is rotatable around the shaft 53 by a predetermined angle.

Three notches 51*a*, 51*b* and 51*c* are formed at predetermined intervals in the longitudinal direction of the slider 47. The interlocking part 52*a* of each arm section 52 is inserted to be linkable with the notches 51*a*, 51*b* and 51*c*. As shown in FIG. 2A, the slider 47 is also energized to the left side in FIG. 2A by a spring member (not shown). In this state, the interlocking part 52*a* of each arm section 52 is held in a non-contact state with the notches 51*a*, 51*b* and 51*c*. Each arm section 52 may be held in this state by the spring member (not shown).

In the eccentric cam 49, if the slider 47 is moved to the left side in FIG. 2A, the interlocking part 52*a* of each arm section 52 is held at a position where the interlocking part 52*a* is not in contact with the notches 51*a*, 51*b* and 51*c* (refer to FIG. 2A). If the slider 47 is moved to the right side in FIG. 2B and FIG. 2C, the interlocking part 52*a* of each arm section 52 is pushed by the notches 51*a*, 51*b* and 51*c* to rotate. Then, the primary transfer rollers 8Y, 8M and 8C are separated from the photoconductive drums 7Y, 7M and 7C across the transfer belt 21 (refer to FIG. 2B and FIG. 2C).

In FIG. 2A to FIG. 2C, a recess 47*a* is formed at the end at the tension roller 43 side of the slider 47. One end 54*a* of a substantially L-shaped operation arm 54 rotatably supported by a shaft 55 is engaged in the recess 47*a*. An operating part 54*b* of the operation arm 54 presses the first position switching roller 42. The first position switching roller 42 is fixed to the other end of a rotation arm 57 which is rotatable about a spindle 57*a*. The first position switching roller 42 is pushed by the operating part 54*b* of the operation arm 54 and presses the transfer belt 21 against the photoconductive drums 7Y, 7M and 7C which are the color photoconductors. The rotation arm 57 may energize the first position switching roller 42 to the slider 47 side by the spring member (not shown).

By moving the slider 47 to the right side in FIGS. 2B and 2C, the operation arm 54 interlocks to rotate clockwise around the shaft 55. The operating part 54*b* of the operation arm 54 is detached from the first position switching roller 42. As a result, the first position switching roller 42 rotates counterclockwise by the tension of the transfer belt 21 to approach the slider 47. The primary transfer rollers 8Y, 8M and 8C retract simultaneously with the first position switching roller 42. Therefore, as shown in FIG. 2B, the transfer belt 21 is displaced in a direction away from the photoconductive drums 7Y, 7M and 7C.

Next, the control mechanism of monochrome photoconductor 46B is described mainly with reference to FIG. 2C and FIG. 4A to FIG. 6B. In the transfer belt unit 6, the control mechanism of monochrome photoconductor 46B is arranged between the slider 47 and the driving roller 31 in the transfer belt 21.

Figure 4A:
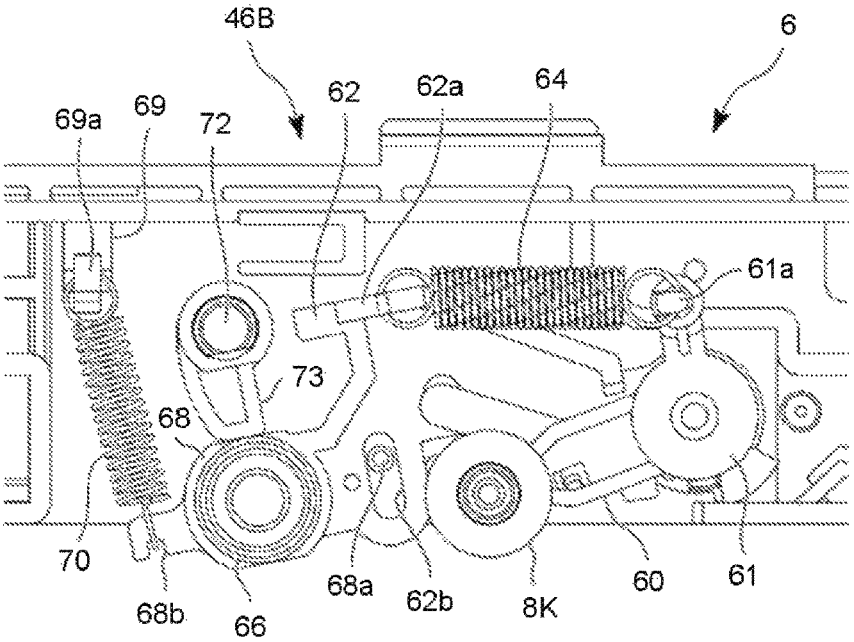
FIG. 4A is a main part front view illustrating a control mechanism of a transfer roller.

In the control mechanism of monochrome photoconductor 46B, the primary transfer roller 8K is connected to a rotation axis 61 via a connection arm 60. An operation arm 62 is connected to the rotation axis 61. The connection arm 60 and the operation arm 62 are integrated to be rotatable around the rotation axis 61. A first coil spring 64 is arranged between a hook 61*a* provided on the rotation axis 61 via a wrist section and a hook 62*a* provided on the operation arm 62. The first coil spring 64 is held in a stretched state. In FIG. 4A, the rotation axis 61 is energized counterclockwise by an energization force of the first coil spring 64. The primary transfer roller 8K fixed to the connection arm 60 presses the transfer belt 21 towards the monochrome photoconductive drum 7K.

Figure 4B:
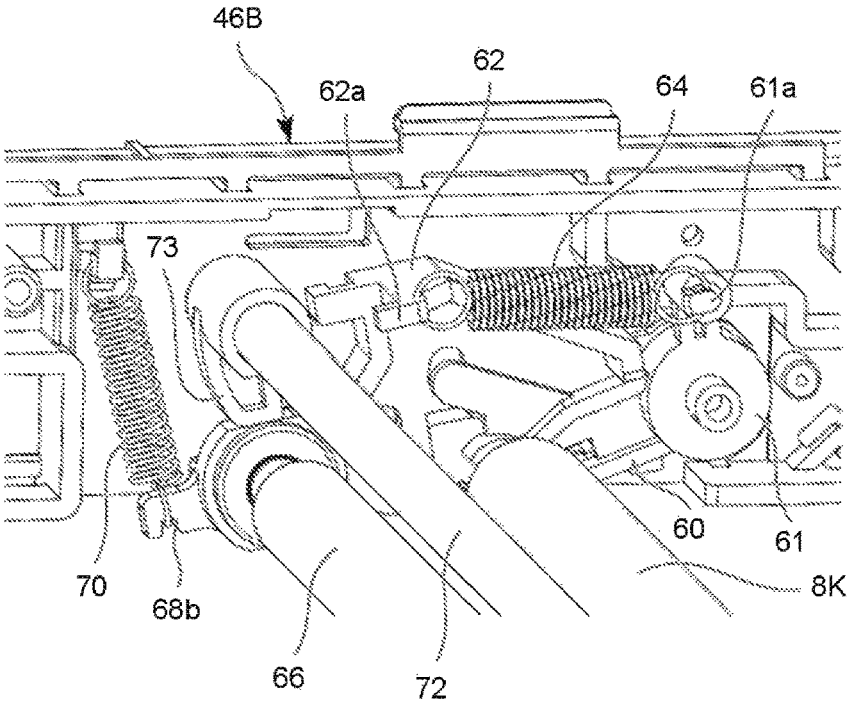
FIG. 4B is a main part perspective view illustrating the control mechanism of the transfer roller.

A second position switching roller 66 is arranged in the vicinity of the primary transfer roller 8K. In FIGS. 4A and 4B, the second position switching roller 66 presses the transfer belt 21 outward. The second position switching roller 66 fixes an operation lever 68 integrally. The operation lever 68 is swingable in a predetermined range around the second position switching roller 66. A pin 68*a* provided in the operation lever 68 is slidably inserted into an elongated hole 62*b* formed in the operation arm 62. The operation lever 68 is swingable within a range of the pin 68*a* and the elongated hole 62*b*. A locking groove 68*b* is formed at the other end of the operation lever 68. A locking part 69*a* is formed on the support part 69 fixed to the base plate. A second coil spring 70 in a stretched state is locked with the locking groove 68*b* of the operation lever 68 and the locking part 69*a* of the support part 69.

In addition, above the second position switching roller 66, a cam 73 rotatable about a spindle 72 is provided. The cam 73 abuts against the end of the second position switching roller 66 and pushes downward. The second position switching roller 66 is pressed downward by the cam 73 against the energization force of the second coil spring 70.

The second position switching roller 66 presses the transfer belt 21 downward between the photoconductive drums 7C and 7K. As a result, the transfer belt 21 is pressed towards the photoconductive drums 7C and 7K. As mentioned above, even if the transfer belt 21 is separated from the photoconductive drums 7Y, 7M and 7C, the transfer belt 21 is pressed to the photoconductive drum 7K by the second position switching roller 66 (refer to FIG. 2B).

Figure 5A:
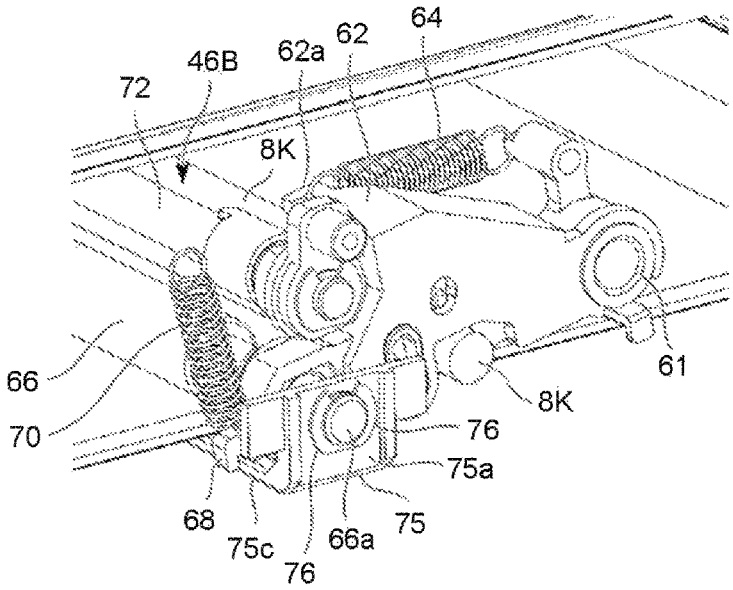
FIG. 5A is a main part perspective view illustrating a second position switching roller and a holding member.
Figure 5B:
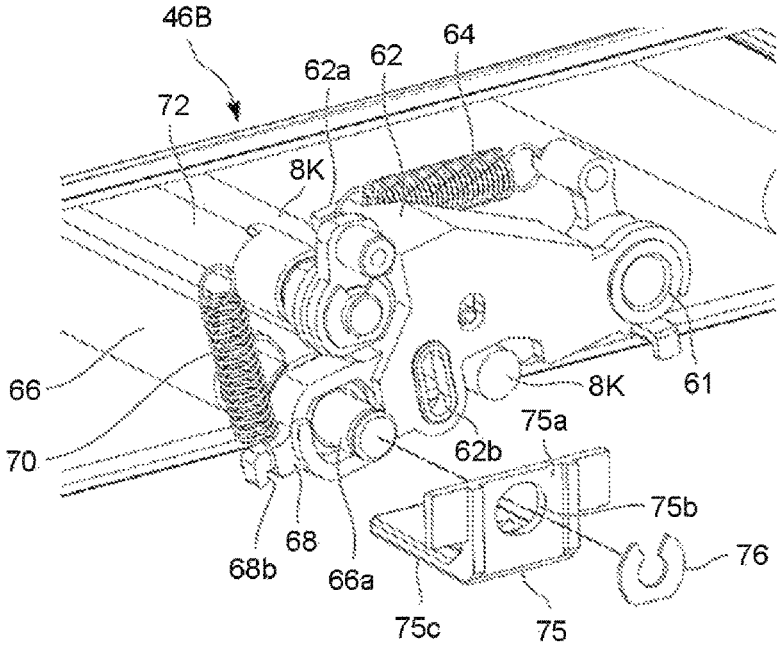
FIG. 5B is an exploded perspective view illustrating the second position switching roller and the holding member.

FIG. 5A and FIG. 5B are diagrams of the control mechanism of monochrome photoconductor 46B shown in FIG. 4A and FIG. 4B as seen from the opposite side. In FIG. 5A and FIG. 5B, a small diameter shaft 66*a* is formed at the end of the second position switching roller 66. The holding member 75 having a substantially L-shaped plate shape is supported by the small diameter shaft 66*a*. A through hole 75*b* is formed in one piece 75*a* of the holding member 75. A small diameter shaft 66*a* of the second position switching roller 66 is inserted through the through hole 75*b* of one piece 75*a* and is locked by a washer 76. The holding member 75 surrounds and lifts the end in the width direction of the transfer belt 21 from the outside with the other piece 75*c* together with the second position switching roller 66. At the time of replacing the photoconductive drum 7K, the transfer belt 21 can be separated from the photoconductive drum 7K to prevent damage thereof. If viewed in the movement direction of the transfer belt 21, the holding member 75 is arranged near the upstream side of the photoconductive drum 7K.

Figure 6A:
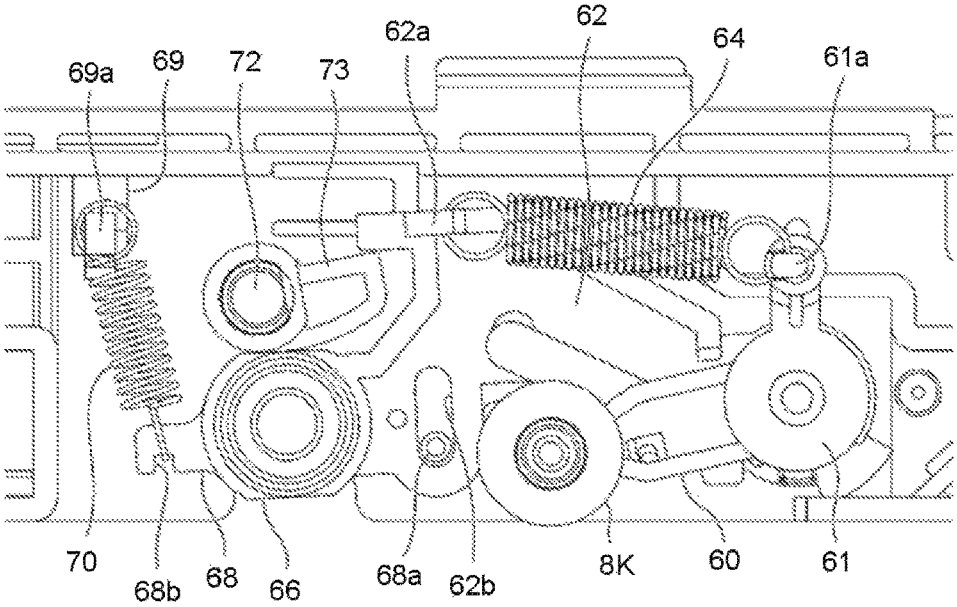
FIG. 6A is a front view illustrating the second position switching roller and a primary transfer roller.
Figure 6B:
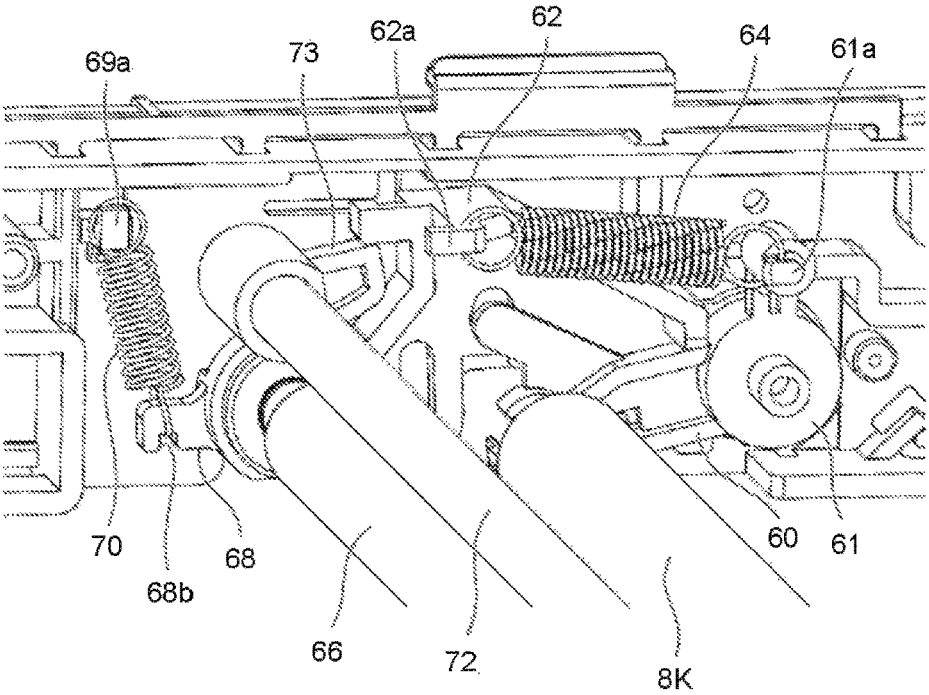
FIG. 6B is a perspective view illustrating the second position switching roller and the primary transfer roller.

FIG. 6A and FIG. 6B show a lifting mechanism of the second position switching roller 66 and the holding member 75. The holding member 75 is omitted in FIG. 6A and FIG. 6B. By rotating the cam 73 provided in the vicinity of the second position switching roller 66 counterclockwise by hand, the cam 73 is detached from the second position switching roller 66. The second position switching roller 66 together with the operation lever 68 is lifted upward by the energization force of the second coil spring 70. The operation lever 68 and the second position switching roller 66 can swing up and down within a cooperation range between the elongated hole 62*b* and the pin 68*a*. The cam 73 pushes the end of the operation arm 62 by 90-degree rotation. Then, the operation arm 62 rotates clockwise around the rotation axis 61. In conjunction with the rotation of the operation arm 62, the connection arm 60 also rotates clockwise so that the primary transfer roller 8K is separated from the photoconductive drum 7K. The second position switching roller 66 and the primary transfer roller 8K interlock to move in a direction away from the photoconductive drum 7K. The holding member 75 is moved in conjunction with the second position switching roller 66 to move the transfer belt 21 in a direction away from the photoconductive drum 7K.

The transfer belt unit 6 of the image forming apparatus 10 according to the present embodiment has the above-described constitution. Next, the operation method of the transfer belt unit 6 is described mainly with reference to FIG. 2A to FIG. 2C and FIG. 7 to FIG. 9.

Figure 7:
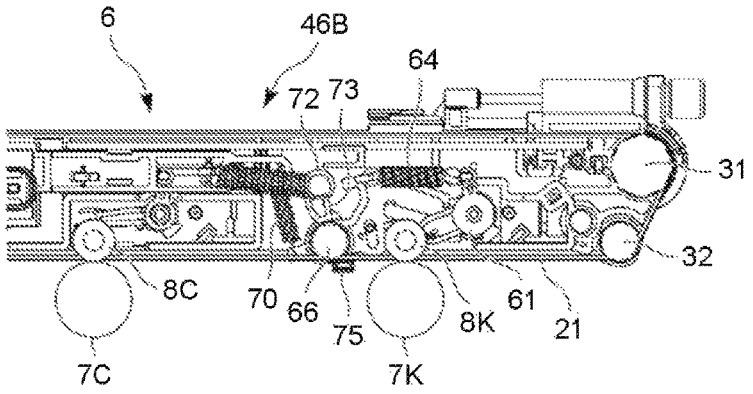
FIG. 7 is a main part enlarged view illustrating the first operation of the transfer belt unit according to the embodiment.

In the full color mode shown in FIG. 2A and FIG. 7, the slider 47 is positioned at the left side. The first position switching roller 42 pushed by the operating part 54*b* of the operation arm 54 presses the transfer belt 21 at the lower side. The second position switching roller 66 also presses the transfer belt 21 at the lower side by the cam 73. The transfer belt 21 is pressed to the photoconductive drums 7Y, 7M, 7C and 7K by the primary transfer rollers 8Y, 8M, 8C and 8K. The holding member 75 supported by the second position switching roller 66 is kept in a non-contact state with the transfer belt 21.

In this state, if the primary transfer voltage is applied to each of the primary transfer rollers 8Y, 8M, 8C and 8K, the primary transfer rollers 8Y, 8M, 8C and 8K primarily transfer the toner images on the photoconductive drums 7Y, 7M, 7C and 7K onto the transfer belt 21. As the sheet P passes through the secondary transfer position between the driving roller 31 and the secondary transfer roller 33, a secondary transfer voltage is applied to the secondary transfer roller 33. If the secondary transfer voltage is applied to the secondary transfer roller 33, the secondary transfer roller 33 secondarily transfers the toner image on the transfer belt 21 onto the sheet P. Then, the toner image on the sheet P is fixed by the fixing device 36. Full color printing of yellow color, magenta color, cyan color, and black color is enabled by the image forming apparatus 10 of the embodiment.

Figure 8:
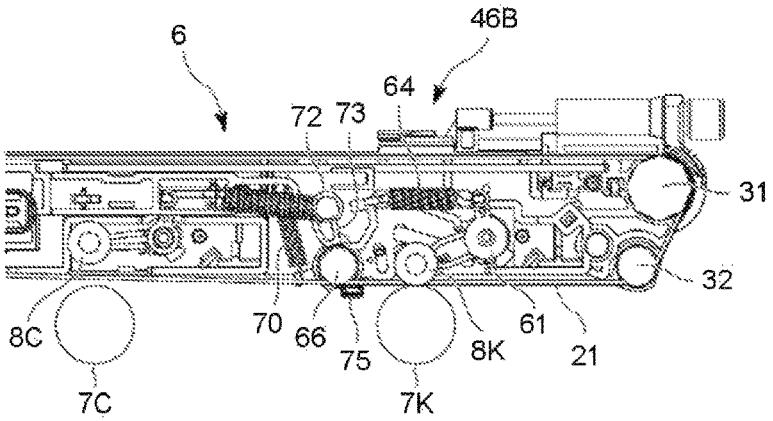
FIG. 8 is a main part enlarged view illustrating the second operation of the transfer belt unit according to the embodiment.

Next, in a monochrome mode shown in FIG. 2B and FIG. 8, the eccentric cam 49 is rotated by 180 degrees by the control mechanism of color photoconductor 46A. Then the slider 47 moves to the right side. In conjunction with the movement of the slider 47, the operation arm 54 rotates clockwise and is detached from the first position switching roller 42. The first position switching roller 42 is rotated counterclockwise by the tension of the transfer belt 21. In conjunction with the movement of the slider 47, the three arm sections 52 also rotate about the shaft 53. As a result, the primary transfer rollers 8Y, 8M and 8C rotate in a direction away from the photoconductive drums 7Y, 7M and 7C. The primary transfer rollers 8Y, 8M and 8C move to the side opposite to the transfer belt 21. The transfer belt 21 is separated from the photoconductive drums 7Y, 7M and 7C for color by the tension thereof.

The primary transfer roller 8K remains at the transfer belt 21 side. The transfer belt 21 is set to the monochrome mode in which the transfer belt 21 contacts only the photoconductive drum 7K for monochrome. The second position switching roller 66 presses the transfer belt 21 against the photoconductive drum 7K. The holding member 75 held by the second position switching roller 66 is kept away from the transfer belt 21.

Therefore, monochrome printing of black color using only the photoconductive drum 7K is enabled. Moreover, since the photoconductive drums 7Y, 7M and 7C for color are separated from the transfer belt 21, the photoconductive drums 7Y, 7M and 7C can be removed and replaced.

Figure 9:
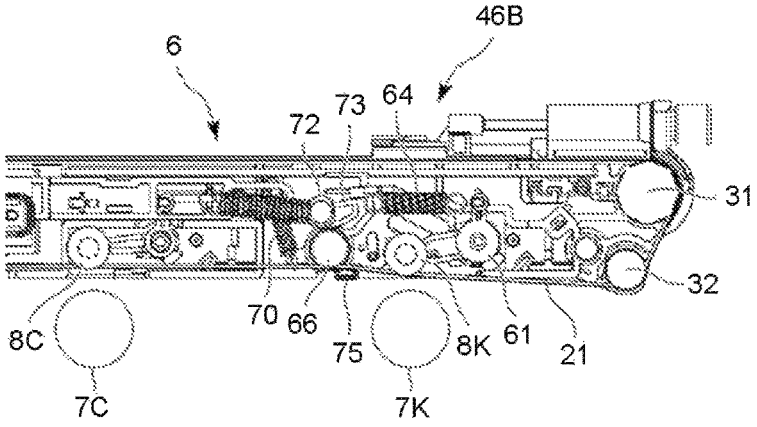
FIG. 9 is a main part enlarged view illustrating the third operation of the transfer belt unit according to the embodiment.

Next, in a maintenance mode shown in FIG. 2C and FIG. 9, by the control mechanism of monochrome photoconductor 46B, the cam 73 is rotated counterclockwise around the spindle 72.

The cam 73 is detached from the second position switching roller 66. The second position switching roller 66 retracts upward from the transfer belt 21 by the energization force of the second coil spring 70. In conjunction with this, the holding members 75 connected to the second position switching roller 66 surround both ends in the width direction of the transfer belt 21 to lift it. The transfer belt 21 is separated from the photoconductive drum 7K.

At the same time, the operation arm 62 pushed by the rotating cam 73 rotates clockwise around the rotation axis 61. Then, since the connection arm 60 also rotates about the rotation axis 61, the primary transfer roller 8K is separated from the photoconductive drum 7K. The transfer belt 21 is separated from the photoconductive drum 7K by the movement of the primary transfer roller 8K.

In this way, the transfer belt 21 moves to a position separated from the four photoconductive drums 7Y, 7M, 7C and 7K. A sufficient space can be ensured between the transfer belt 21 and the photoconductive drums 7Y, 7M, 7C and 7K. Even if both ends in the width direction of the transfer belt 21 stretch as time elapses, the both ends can be held by the holding members 75. The transfer belt 21 does not hang down to the photoconductive drums 7Y, 7M, 7C and 7K side due to empty weight thereof. Therefore, the photoconductive drums 7Y, 7M, 7C and 7K can be removed without contacting with the transfer belt 21 to be replaced.

As mentioned above, the transfer belt unit 6 of the image forming apparatus 10 according to the present embodiment is provided with the holding members 75 holding both ends of the transfer belt 21 in the second position switching roller 66. Therefore, even if both ends of the transfer belt 21 stretch as time elapses, a sufficient space can be ensured at the position where the transfer belt 21 is separated from the photoconductive drums 7Y, 7M, 7C and 7K. It is possible to prevent the transfer belt 21 from being damaged at the time of replacing the photoconductive drums 7Y, 7M, 7C and 7K.

Moreover, since it does not increase the tension of the transfer belt 21, it does not increase the elongation of the transfer belt 21. It is conceivable to increase the outward movement amount of a tension adjusting member of the tension roller 43 which applies the tension to the transfer belt 21. If the elastic force of the tension spring 45 applied to the tension adjusting member is increased, the stretched transfer belt 21 can be separated from the photoconductive drum. However, by increasing the elastic load of the tension spring 45, the tension applied to the transfer belt 21 at the beginning increases. In this case, the elongation of the transfer belt 21 is increased, which is not preferable.

Especially as both ends in the width direction of the transfer belt 21 tend to stretch as time elapses, both ends of the transfer belt 21 are surrounded with the holding members 75 at both sides to be held. This prevents hanging of the transfer belt 21 due to the elongation of both ends. Moreover, the holding member 75 is connected to the second position switching roller 66. Therefore, in conjunction with the operation of separating the second position switching roller 66 from the transfer belt 21, the holding members 75 can surround both ends to lift the transfer belt 21.

In the modification of the present embodiment, the same or similar parts and members are donated with the same reference numerals as those in the above-described embodiment.

In the embodiment described above, the holding members 75 connected to the second position switching roller 66 are arranged at both ends in the width direction of the transfer belt 21, and only both ends of the transfer belt 21 are gripped. Alternatively, as a modification, the holding members 75 at both ends in the width direction of the transfer belt 21 may be continuously formed by extending the holding members 75 over the whole length and connecting them together. In this case, the transfer belt 21 can be surrounded over the full width.

Figure 10:
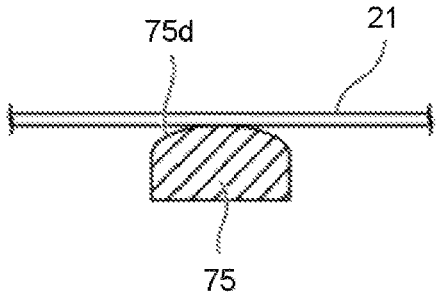
FIG. 10 is a diagram illustrating a modification of a holding member.

As shown in FIG. 10, the holding member 75 may form a convex curved surface 75*d* that abuts against the transfer belt 21. This can eliminate the possibility that the holding member 75 damages the transfer belt 21. As another example, the part of the holding member 75 that abuts against the transfer belt 21 may be formed in a bar shape.

In the embodiment, the holding member 75 is provided at the upstream side of the photoconductive drum 7K in the direction of movement of the transfer belt 21. Alternatively, the holding member 75 may be provided at the downstream side of the photoconductive drum 7K. For example, the holding member 75 may be connected to the connection arm 60 instead of the second position switching roller 66. Even in this case, the holding member 75 can hold the transfer belt 21 in conjunction with the second position switching roller 66 and separate it from the photoconductive drum 7K.

In the embodiment described above, the transfer belt unit 6 provided in the image forming apparatus 10 is described. An example is described in which the transfer belt unit 6 according to the embodiment is a unit including the transfer belt 21 used for the image forming apparatus 10. The transfer belt unit 6 of the present embodiment is not limited to the image forming apparatus 10. It is applicable to various transfer belt units 6 having the endless transfer belt 21.

In the embodiment, the second position switching roller 66 is not limited to a roller. A bar or a plate may be used. These members are included in a switching member.

According to at least one embodiment described above, the holding members 75 are provided in the second position switching roller 66 to hold both ends of the transfer belt 21. Therefore, even if both ends of the transfer belt 21 stretch as time elapses, a sufficient space can be ensured at the position where the transfer belt 21 is separated from the photoconductive drums 7Y, 7M, 7C and 7K. It is possible to prevent the transfer belt from being damaged at the time of replacing the photoconductive drums 7Y, 7M, 7C and 7K. Moreover, there is no need to increase the tension of the transfer belt 21.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A transfer belt unit, comprising:
a transfer belt having an endless shape;
a transfer roller arranged at an inside of the transfer belt facing a photoconductor;
a switching member configured to switch the transfer belt between a transfer position where the transfer belt abuts against the photoconductor and a separation position where the transfer belt is away from the photoconductor; and
a holding member configured to separate the transfer belt from the photoconductor in conjunction with the switching member, wherein
movement of the transfer roller and movement of the switching member are interlocked.

2. The transfer belt unit according to claim 1, wherein
in conjunction with the transfer roller separated from the photoconductor, the holding member is configured to move to separate the transfer belt from the photoconductor.

3. The transfer belt unit according to claim 1, wherein
the holding member supports the transfer belt from underneath the transfer belt at a side of the transfer belt in a width direction.

4. The transfer belt unit according to claim 1, comprising two holding members and the holding members are arranged at both ends in a width direction of the transfer belt.

5. The transfer belt unit according to claim 1, wherein
the holding member is arranged across a whole length in a width direction of the transfer belt.

6. The transfer belt unit according to claim 1, wherein
a surface abutting against the transfer belt of the holding member is a curved surface.

7. The transfer belt unit according to claim 1, wherein
the holding member is arranged nearby a monochrome photoconductor of the photoconductor.

8. The transfer belt unit according to claim 1, wherein
the holding member is arranged at an upstream side or a downstream side of a monochrome photoconductor of the photoconductor in a conveyance direction of the transfer belt.

9. The transfer belt unit according to claim 1, wherein
the transfer belt is wrapped around a driving roller and a plurality of primary transfer rollers.

10. The transfer belt unit according to claim 1, wherein
the transfer belt is arranged to face a plurality of photoconductive drums.

11. An image forming apparatus, comprising:
a transfer belt unit; and
a photoconductor arranged to face a transfer roller across a transfer belt, wherein
the transfer belt unit comprises:
the transfer belt having an endless shape;
the transfer roller arranged at an inside of the transfer belt facing the photoconductor;
a switching member configured to switch the transfer belt between a transfer position where the transfer belt abuts against the photoconductor and a separation position where the transfer belt is away from the photoconductor; and
a holding member configured to separate the transfer belt from the photoconductor in conjunction with the switching member, wherein
movement of the transfer roller and movement of the switching member are interlocked.

12. The image forming apparatus according to claim 11, wherein
in conjunction with the transfer roller separated from the photoconductor, the holding member is configured to move to separate the transfer belt from the photoconductor.

13. The image forming apparatus according to claim 11, wherein
the holding member supports the transfer belt from underneath the transfer belt at a side of the transfer belt in a width direction.

14. The image forming apparatus according to claim 11, comprising two holding members and the holding members are arranged at both ends in a width direction of the transfer belt.

15. The image forming apparatus according to claim 11, wherein
the holding member is arranged across a whole length in a width direction of the transfer belt.

16. The image forming apparatus according to claim 11, wherein
a surface abutting against the transfer belt of the holding member is a curved surface.

17. The image forming apparatus according to claim 11, wherein
the transfer belt is wrapped around a driving roller and a plurality of primary transfer rollers.

18. The image forming apparatus according to claim 11, wherein
the transfer belt is arranged to face a plurality of photoconductive drums.

* * * * *